United States Patent [19]

Jang

[11] Patent Number: 5,005,256

[45] Date of Patent: Apr. 9, 1991

[54] STRUCTURE OF HINGE

[76] Inventor: Yeong-An Jang, 2F., No. 207, Sec. 2, Chang Chiang Rd., Pan Chia, Taipei Hsien, Taiwan

[21] Appl. No.: 589,570

[22] Filed: Sep. 28, 1990

[51] Int. Cl.[5] ..... E05D 5/00

[52] U.S. Cl. ..... 16/384

[58] Field of Search ..... 16/384, 382, 383, 388, 16/389

[56] References Cited

U.S. PATENT DOCUMENTS 2,714,741 8/1955 Derman ..... 16/384
4,034,512 7/1977 Lindal ..... 16/384
4,406,035 9/1983 Schmale ..... 16/384

*Primary Examiner*—Richard K. Seidel
*Assistant Examiner*—Edward A. Brown
*Attorney, Agent, or Firm*—Varndell Legal Group

[57] ABSTRACT

A hinge for securing a swinging door to a door frame without the use of fastening screws, which is comprised of two pivoted parts having each a plurality of pointed teeth and a plurality of notches around its periphery. The pointed teeth of the two pivoted parts are stricken to respectively fasten inside the swinging door and the door frame and motorized nailing tool is used to fasten U-nails through the notches to fixedly secure the two pivoted parts to the swinging door and door frame.

1 Claim, 3 Drawing Sheets

STRUCTURE OF HINGE

BACKGROUND AND SUMMARY OF THE INVENTION

The present invention is related to hinges, and more particularly to a hinge for connecting two wooden objects together permitting one to swing against the other, which can be conveniently fastened without drilling fastening holes in advance or the use of any screws.

The hinge is a joint for connecting two objects (more particularly two wooden objects) together permitting one to swing against the other. Before connecting one wooden object to the other, mounting holes must be accurately drilled on the two wooden objects to connect them, so that the two pivoted parts of a hinge can be respectively mounted on the two wooden objects by screws. If the fastening holes are not precisely made at correct locations, the two wooden objects will not be stably connected together. While driving screws in a wooden object to secure a hinge thereto, the slot on the head of each screw may be damaged by force to obstruct hinge mounting operation. Because regular metal screws will gather rust easily under the weather, a hinge may displace from its position after a certain period in service, causing loosening of the connected swinging door.

The present invention has been accomplished to eliminate the aforesaid problems. According to the present invention, no mounting holes have to be drilled in advance nor are any screws required to fasten a hinge of the present invention. The mounting of a hinge becomes more simple and convenient.

DETAILED DESCRIPTION OF THE PREFERRED EMBODIMENT

Figure 1:
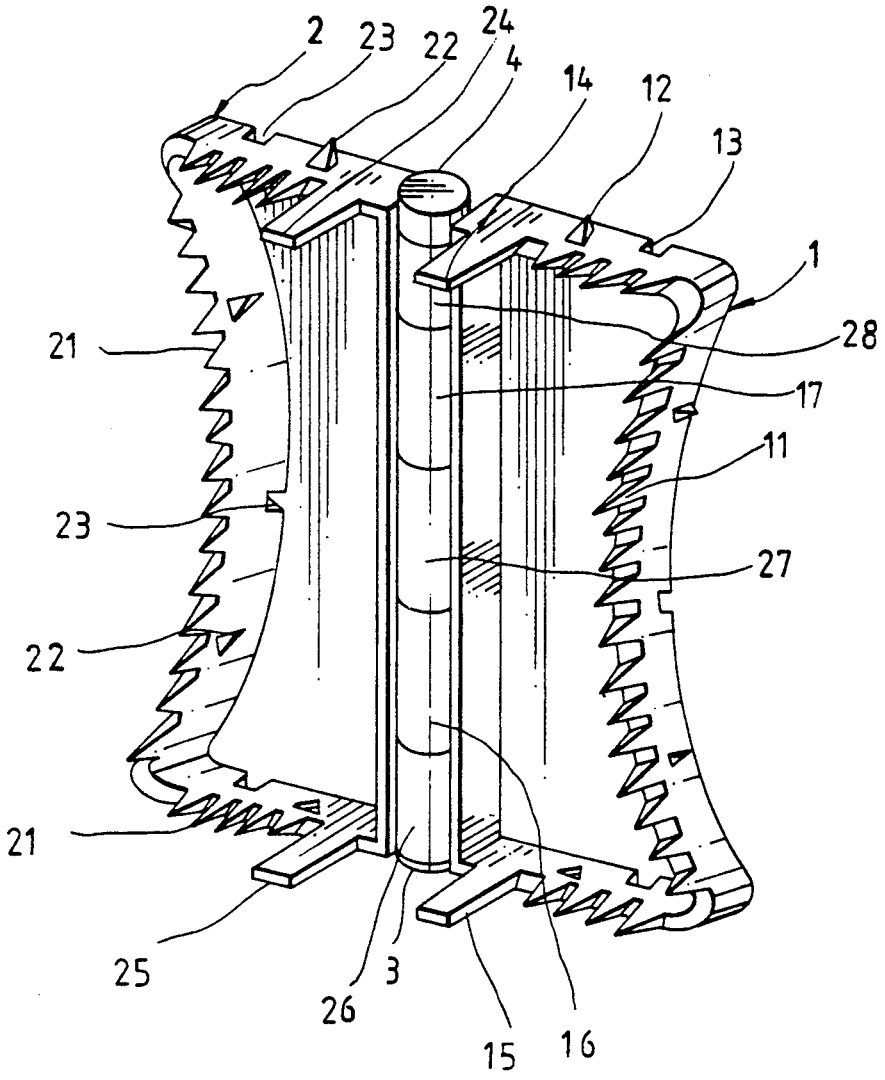
FIG. 1 illustrates the preferred embodiment of the present invention.
Figure 2:
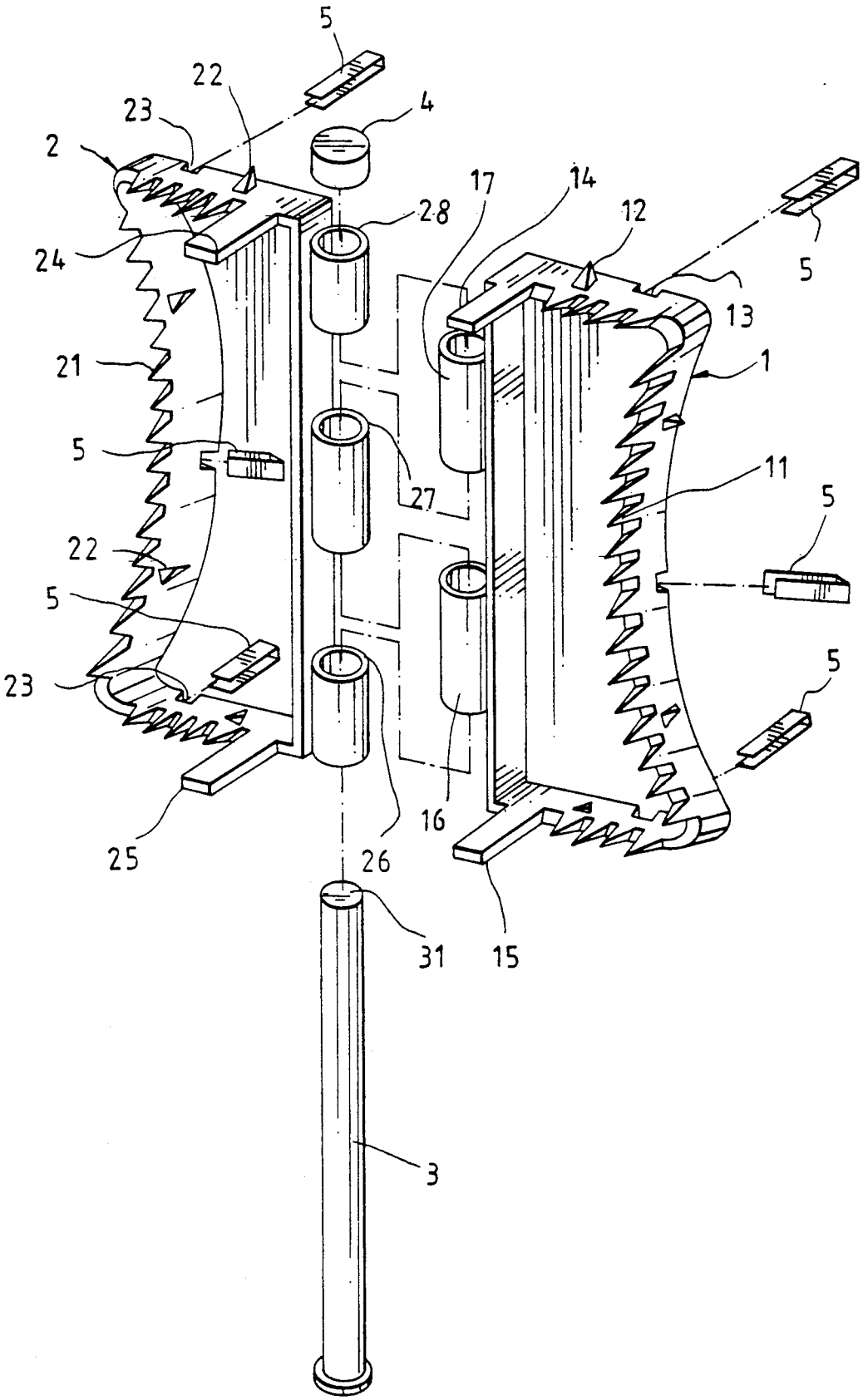
FIG. 2 is a perspective dismantled view thereof.
Figure 3:
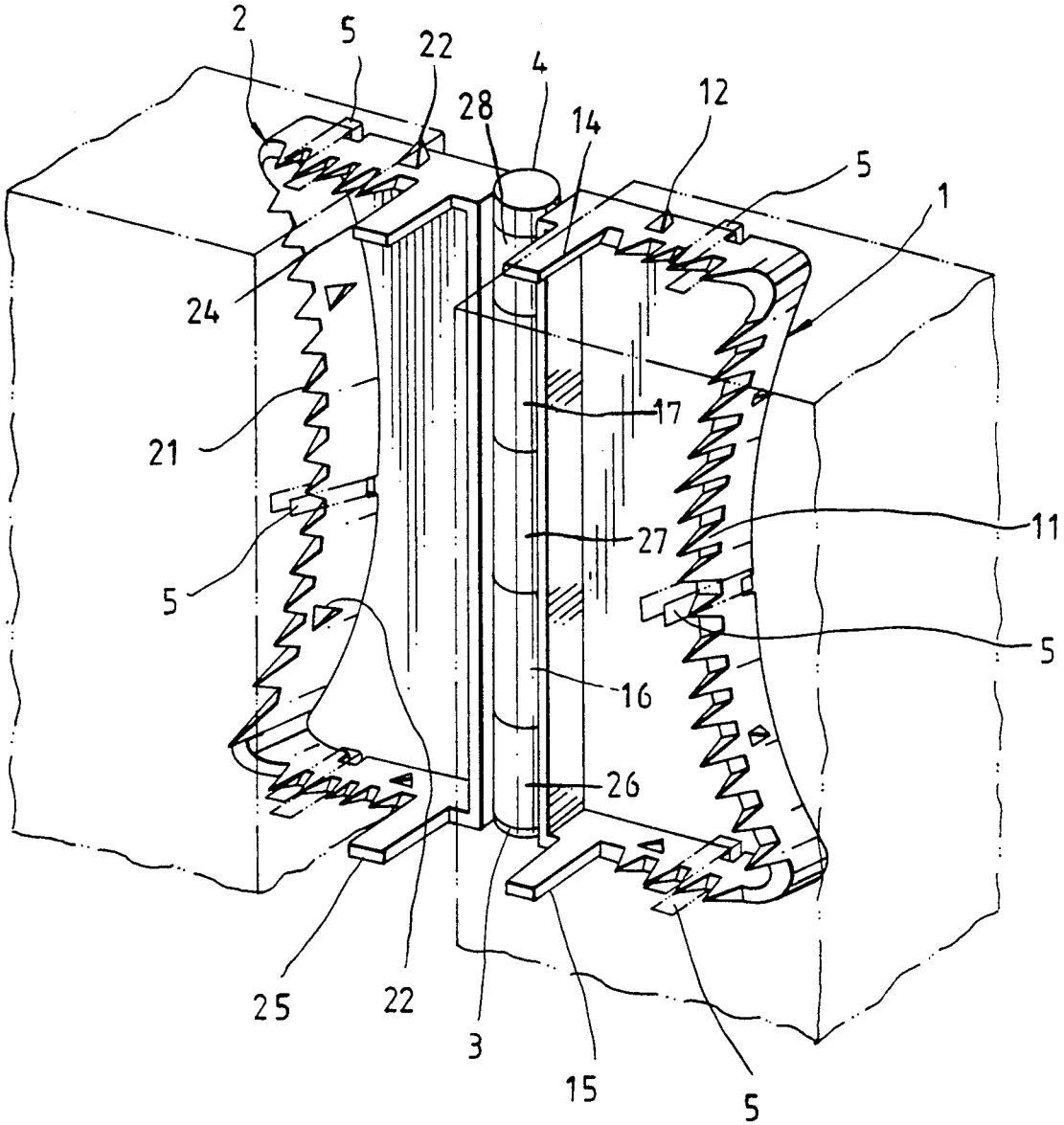
FIG. 3 illustrates the use of the preferred embodiment to secure two wooden objects together permitting one to swing against the other.

Referring to the annexed drawings in greater detail, therein illustrated is a hinge embodying the present invention and generally comprised of two pivoted parts 1, 2. The right-hand part 1 is substantially in a rectangular shape having two rectangular strips 14, 15 extending therefrom at the back near the two opposite ends of the side whereto the left-hand part 2 is pivoted, a plurality of pointed teeth 11 extending therefrom at the back around the other sides, a plurality of pyramidal projections 12 transversely extending therefrom around the periphery of the other sides, a plurality of notches 13 around the edge of the other sides, two sleeves 16, 17 spaced from each other at the side whereto the left-hand part 2 is pivoted. The left-hand part 2, similar to the right-hand part 1, is substantially in a rectangular shape having two rectangular strips 24, 25 extending therefrom at the back near the two opposite ends of the side whereto the right-hand part 1 is pivoted, a plurality of pointed teeth 21 extending therefrom at the back around the other sides, a plurality of pyramidal projections 22 transversely extending therefrom around the periphery of the other sides, a plurality of notches 23 around the edge of the other sides, three sleeves 26, 27, 28 spaced from one another at the side whereto the right-hand part 1 is pivoted. The sleeves of the right-hand part 1 and the sleeves of the left-hand part 2 are respectively made at such locations that the sleeves of the right-hand part 1 can be alternatively engaged in between the sleeves of the left-hand part 2 and connected thereto in series when the right-hand part 1 and the left-hand part 2 are pivoted.

When desired to connect two wooden objects together permitting one to swing against the other, the two parts 1, 2 are respectively fastened in the two wooden objects to connect at a suitable location on the edge. Because of the design of the two rectangular strips 14, 15 or 24, 25, the two parts 1, 2 can be conveniently attached to the two wooden objects at a desired position. By using a square wooden bar to hit the body of the part 1 or 2, the pointed teeth 11, 21 and the pyramidal projections 12, 22 of the two parts 1, 2 can be conveniently fastened inside the two wooden objects to connect them. Because of the effect of the pyramidal projections 12, 22, the two parts 1, 2 are more tightly bound to the two wooden objects. After the two parts 1, 2 are respectively firmly attached to the two wooden objects, a motorized tool is used to fasten U-shaped nails 5 in the notches 13, 23 so as to fixedly secure the two parts 1, 2 to the two wooden objects respectively. After the two parts 1, 2 are respectively fastened on the two wooden objects to connect them, the two wooden objects are moved close to each other permitting the sleeves 16, 17 of the right-hand part 1 to alternatively engage in between the sleeves 26, 27, 28 of the left-hand part 2 so that a tubular fastening rod 3 can be inserted through the sleeves 16, 17, 26, 27, 28 to secure the two parts 1,2 together. After inserting through the sleeves of the two parts 1, 2, a rivet 4 is fastened in the end 31 of the fastening rod 3 to secure the fastening rod 3 to the sleeves of the two parts 1, 2 so that the fastening rod 3 is protected from breaking away.

I claim:

1. A hinge for connecting two wooden members together permitting one to swing about the other, comprising a first part pivoted to a second part, said first part having two rectangular strips, each strip extending from its periphery in a first direction substantially perpendicular to a plane defining its back surface and located adjacent to an opposite end of its pivot axis about which said second part is pivoted, a plurality of pointed teeth also extending in said first direction from the periphery on three sides thereof, a plurality of pyramidal projections extending in a second direction transverse to said first direction around the periphery of the three sides thereof, a plurality of notches around the edges of the three sides thereof, a plurality of sleeves spaced axially from each other along said pivot axis; said second part having two rectangular strips, each strip extending from its periphery in a third direction substantially perpendicular to a plane defining its back surface and located adjacent to an opposite end of its pivot axis about which said first part is pivoted, a plurality of pointed teeth also extending in said third direction from the periphery on three sides thereof, a plurality of pyramidal projections extending in a fourth direction transverse to said third direction around the periphery of the three sides thereof, a plurality of notches around the edges of the three sides thereof, a plurality of sleeves spaced axially from each other along said pivot axis, wherein the sleeves of said first part are alternately engaged in between the sleeves of said second part and connected thereto in series by a fastening rod coupled at one end with a rivet.

* * * * *